US006670781B2

(12) United States Patent
Weindorf

(10) Patent No.: US 6,670,781 B2
(45) Date of Patent: Dec. 30, 2003

(54) COLD CATHODE FLUORESCENT LAMP LOW DIMMING ANTIFLICKER CONTROL CIRCUIT

(75) Inventor: Paul Fredrick Luther Weindorf, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 113 days.

(21) Appl. No.: 09/917,128

(22) Filed: Jul. 27, 2001

(65) Prior Publication Data

US 2003/0025462 A1 Feb. 6, 2003

(51) Int. Cl.[7] ..... H05B 37/02

(52) U.S. Cl. ..... 315/307; 315/DIG. 4; 315/291; 315/308

(58) Field of Search ..... 315/DIG. 4, 219, 315/224, 247, 244, 291, 307, 308; H05B 37/02

(56) References Cited

U.S. PATENT DOCUMENTS 4,096,413 A * 6/1978 Alley ..... 315/276
4,379,254 A * 4/1983 Hurban ..... 315/291
4,441,053 A * 4/1984 Daspit ..... 315/206
5,015,924 A * 5/1991 Berman et al. ..... 315/324
5,030,887 A * 7/1991 Guisinger ..... 315/158
5,041,763 A 8/1991 Sullivan et al.
5,668,446 A * 9/1997 Baker ..... 315/294
5,930,121 A 7/1999 Henry
5,936,357 A * 8/1999 Crouse et al. ..... 315/247
5,939,830 A 8/1999 Praiswater
5,973,437 A 10/1999 Gradzki et al.
6,011,360 A 1/2000 Gradzki et al.
6,037,722 A * 3/2000 Moisin ..... 315/307
6,133,696 A * 10/2000 Tavares et al. ..... 315/194
6,211,623 B1 * 4/2001 Wilhelm et al. ..... 315/224

OTHER PUBLICATIONS

Linfinity Microelectronics Inc., RangeMAX™ LX 1686, Digital Dimming CCFL Controller IC, Preliminary Data Sheet, pp. 1–5, © 2000.

Linfinity Application Note AN–13, LX 1686 Direct Drive CCFL Inverter Design Reference, George Henry, Linfinity Microelectronics, pp. 1–25, © 2000.

* cited by examiner

*Primary Examiner*—Tho Phan
(74) *Attorney, Agent, or Firm*—Brinks Hofer Gilson & Lione

(57) ABSTRACT

A flicker reduction method for a lamp assembly includes providing current pulses to a fluorescent lamp in response to a periodic signal such as a ramp voltage. The current pulses illuminate the fluorescent lamp. The method further includes providing at least a predetermined number of current pulses to the fluorescent lamp per period of the periodic signal. A feedback circuit samples current in the fluorescent lamp to ensure that a predetermined number of current pulses have been provided. After the pulses are provided, the circuit is reset for the next cycle of the periodic signal.

24 Claims, 5 Drawing Sheets

| FIG. 1-1 | FIG. 1-2 |
|---|---|

COLD CATHODE FLUORESCENT LAMP LOW DIMMING ANTIFLICKER CONTROL CIRCUIT

BACKGROUND OF THE INVENTION

1. Field of the Invention

The present invention relates generally to control circuits for fluorescent lamps. More particularly, the present invention relates to a low dimming antiflicker control circuit for a cold cathode fluorescent lamp.

2. Discussion of Related Art

Historically and currently, cold cathode fluorescent lamps (CCFLs) have been used to back light liquid crystal displays (LCDs). CCFLs are well suited to this application due to their low cost and high efficacy. High efficacy, which is equal to the ratio of light output to input power, is required because typical LCDs only transmit about 5% of the backlighting due to absorption of light in the polarizer and color filter of the LCD. In order to produce usable daytime lighting levels of approximately 400 Nits, the backlight must be capable of 20×400 Nits. One Nit is the luminance of one candle power measured one meter away over a meter by meter area, also known as a candela per meter squared. A cost effective backlighting technology which can provide such a lighting level is a fluorescent lamp.

Although the CCFL is an extremely efficient light source, it is difficult to control down to the low dimming levels required by, for example, night time automotive environments. In one automotive specification, the requirement for dimming is to a barely discernable level, which is in the range of 1.0 Nit for an active matrix LCD. Accordingly, the CCFL controller must be capable of producing a dimming ratio of 400:1.

Most CCFL controllers have difficulty in controlling the absolute luminance down to the level of imperceptibility. Some known systems obtain the desired dimming ratio by overdriving the lamp. However, this rapidly reduces the operating life of the lamp. Some military LCD systems use a first lamp for daytime illumination and a second, smaller lamp to produce the required night time lighting levels. However, systems which utilize dual lighting sources are not cost competitive in the automotive environment. Not only is a second lamp required, but a second controller is required as well.

Many control schemes have been used to control fluorescent lighting. Examples include voltage controlled self-resonant oscillators, pulse-by-pulse current pulse width modulated (PWM) control and PWM duty cycle control systems or combinations thereof. Pulse-by-pulse current PWM control systems characteristically operate at a frequency of 20 KHz to 100 KHz to control the lamp current. PWM duty cycle control of the CCFL luminance is accomplished by duty cycle control of the lamp's on time to the total periodic update time. As an example of PWM duty cycle control, if the operational frequency of the CCFL driver is 60 KHz and, a periodic PWM update frequency of 2×60 Hz or 120 Hz is used, then an update time of 8.33 msec (1/120 Hz) results. In this example, there are a total of 500 (8.33 msec×60 KHz) lamp current drive cycles per update time. Therefore, if 50% luminance is desired, the CCFL only turns on the lamp for 250 out of the total possible 500 cycles for each update period. If the lamp were turned on for only 1 out of 500 cycles, the dimming ratio would be 500:1. However, practical lamps require several current pulses to start the flow of lamp current.

In order to obtain a cost effective dimming controller for automotive applications, a variation of a commercially available product must be used. Until recently, most controllers were variations of a self-resonant oscillator configuration which is sufficient for lap top personal computer (PC) applications, for example. Such controllers do not have the dimming control range required for automotive applications. However, a dimming solution being used more often is a direct drive (non-resonant) PWM controller. One example is the model LX1686 controller produced by LinFinity Microelectronics of Garden Grove, Calif. This controller features both PWM duty cycle and pulse-by-pulse lamp current PWM control. The cycle-by-cycle lamp current control is especially useful because the current level of each cycle can be either a low night-time value, a normal day-time value or a boosted value for rapid heating during cold weather conditions. Moreover, this controller is extremely cost competitive and therefore suitable for cost-sensitive automotive applications.

While this controller has substantial advantages, for some applications this controller has the disadvantage of being unable to control the minimum number of current pulses over temperature for the desired low luminance operation. A minimum number of current pulses is required each PWM duty cycle to prevent the plasma from extinguishing and requiring a restart operation which will cause the lamp to flicker. Accordingly, there is a need for an improved controller permitting accurate control of the minimum number of current cycle pulses, thereby allowing flicker free operation over the automotive temperature range.

SUMMARY

By way of introduction only, a flicker reduction method for a lamp assembly includes providing current pulses to illuminate a fluorescent lamp in response to a periodic signal such as a ramp voltage. A feedback circuit samples current in the fluorescent lamp to ensure that a predetermined number of current pulses have been provided to the fluorescent lamp per period of the periodic signal. After the pulses are provided, the circuit is reset for the next cycle of the periodic signal.

The foregoing discussion of the preferred embodiments has been provided only by way of introduction. Nothing in this section should be taken as a limitation on the following claims, which define the scope of the invention.

BRIEF DESCRIPTION OF SEVERAL VIEWS OF THE DRAWINGS

FIGS. 1–1 is the left portion of the schematic diagram. FIGS. 1–2 is the right portion of the schematic diagram;

FIG. 2 is a first timing diagram illustrating operation of the control circuit of FIG. 1.

DETAILED DESCRIPTION OF THE PRESENTLY PREFERRED EMBODIMENTS

Figure 1:
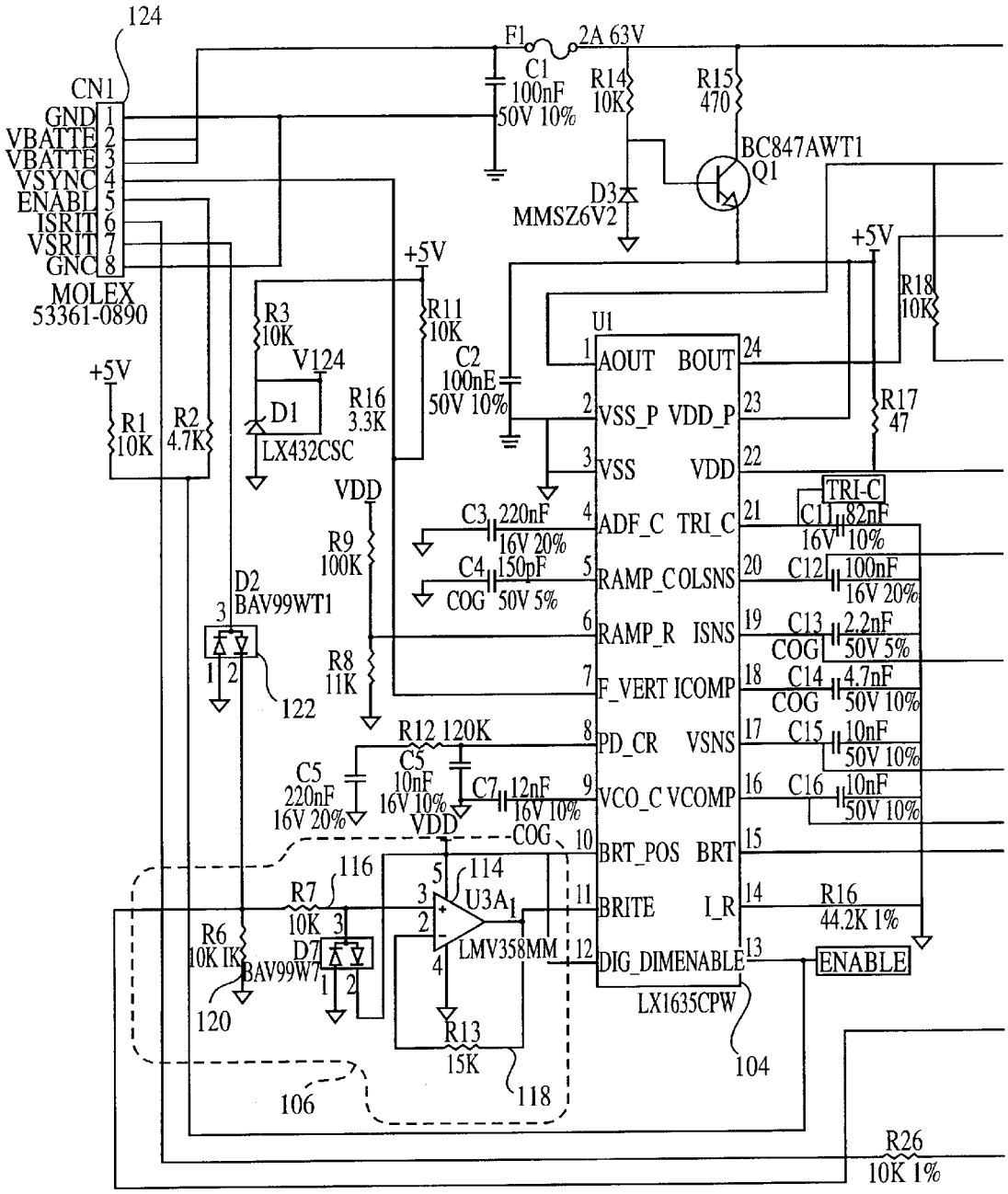
FIG. 1 is a schematic diagram of an embodiment of a control circuit for a cold cathode fluorescent lamp. It consists of two portions, as shown.

FIG. 1 is a schematic diagram of a control circuit 100 for a fluorescent lamp, embodied as a cold cathode fluorescent lamp (CCFL) 102. In the illustrated embodiment, the control circuit 100 includes a controller 104, an input override circuit 106, a feedback comparator circuit 108, a driver for the CCFL 102 such as transistors 110 and transformer 112, and a connector 124, the operation of which will be explained below. Together with the lamp 102, the control circuit 100 forms a lamp module suitable for illuminating liquid crystal displays and other applications.

The controller 104 generates a periodic ramp voltage signal for pulse-width modulation (PWM) of current pulses to the fluorescent lamp 102. An external 60 Hz vertical synchronization signal (VSYNC) is provided to the controller 104. Internal to the controller 104, a phase locked loop function takes the 60 Hz VSYNC signal and doubles the frequency to develop a 120 Hz vertical ramp signal. This vertical ramp signal is used to accomplish the PWM function. The ramp voltage is a sawtooth with a voltage range in the present embodiment of 0.5V to 2.5V.

The controller 104 uses a dimming level input signal (VBRITE) and compares it to the internally generated ramp signal to establish the PWM signal on time. Another oscillator internal to the controller 104 generates signals required to control transistors 110 and transformer 112 at a frequency, for example of 76 KHz. Internal logic of the controller 104 is used to turn on the transistors 110 at the 76 KHz rate only during the PWM on time.

The controller 104 in the illustrated embodiment is a LX1686CPW digital dimming CCFL inverter module sold by LinFinity Microelectronics Inc. of Garden Grove, Calif. The controller 104 receives a control signal and provides the operational signals necessary to drive the CCFL 102. The controller 104 includes a dimming input, pin 11 of the controller 104 labeled BRITE, which receives a brightness control signal and which permits brightness control from an external potentiometer or DC voltage source. In response to receiving the brightness control signal, the controller 104 produces a burst drive of current pulses to energize the CCFL 102. Thus, the controller generates control signals in response to a received brightness control signal. The controller 104 further receives a vertical synchronization signal at pin 7 of the controller 104. The vertical synchronization signal defines the video frame rate for the liquid crystal display (LCD) illuminated by the CCFL 102. The controller 104 further generates a periodic ramp voltage signal at pin 5 of the controller 104. This ramp waveform is compared to the BRITE input signal (pin 11 of the controller 104) and if the BRITE voltage is above the ramp voltage, the lamp is driven with current pulses. When the ramp voltage exceeds the BRITE input signal, the CCFL is not driven. In this manner, the percent of "on" to total ramp period time can be controlled to control the percent of time the lamp is driven to obtain the desired luminance. The other pins of the controller 104 operate as defined by the data sheet for the LX1686CPW CCFL inverter module as published by LinFinity Microelectronics Inc. Other suitable devices, including integrated circuits and discrete circuits may be substituted for the LX1686CPW to perform the function provided by the controller 104. For example, the LXM1611 direct drive CCFL inverter module, also manufactured by LinFinity Microelectronics may be substituted, as well as any other suitable device.

The input override circuit 106 normally provides the dimming level input signal from pin 7 of connector 124 which can be overridden by the voltage from comparator 126 to ensure that a minimum number of lamp current pulses have occurred for each voltage ramp period. The unity gain buffer circuit of the input override circuit 106 includes an operational amplifier 114 and input resistor 116 and a feedback resistor 118. The operational amplifier 114 in the illustrated embodiment is a model LMV358MM operational amplifier of the type available from several manufacturers. The operational amplifier 114 has a non-inverting input coupled to the input resistor 116 and an inverting input coupled through the feedback resistor 118 to an output of the operational amplifier 114. The output of the operational amplifier 114 is also coupled to the BRITE input, pin 11 of the controller 104. The resistor 116 is also coupled to a resistor 120 and, through a diode network 122, to a brightness control input of the connector 124.

As noted, in this configuration, the operational amplifier 114 is operated as a buffer providing substantially unity gain. The amplifier 114 replicates the voltage at the cathode of the diode 122 but with a lower output impedance than is seen at the diode 122.

The connector 124 is configured to receive a variety of control signals as well as power, labeled VBATTERY or battery voltage, and ground. In one application, the module including the control circuit 100 and CCFL 102 is employed in an automotive environment where a battery voltage of approximately 12 volts powers the module. Other operating voltages such as a 5 volts for integrated circuits forming the control circuit 100 may be generated from the battery voltage.

The feedback comparator circuit 108 is a feedback circuit which detects current in the fluorescent lamp 102 to control the dimming level input signal at predetermined operating conditions of the control circuit 100, such as at low luminance operation. The feedback comparator circuit 108 includes an operational amplifier 126, a feedback resistor 128, a grounding resistor 129, an output resistor 130, an input resistor 132, a capacitor 134, a charging resistor 136, a discharging resistor 138 and a diode 140. The capacitor 134 and the charging resistor 136 are coupled to the inverting input of the operational amplifier 126. The input resistor 132, the feedback resistor 128 and the grounding resistor 129 are coupled to the non-inverting input of the operational amplifier 126. The output of the operational amplifier 126 is coupled through the output resistor 130 to the non-inverting input of the operational amplifier 114, through the input resistor 116 of the input override circuit 106. The feedback comparator circuit 108 senses current in the CCFL 102 through the diode 140 to provide feedback control of the lamp current provided to the CCFL 102 by the control circuit 100. Operation of the feedback comparator circuit 108 will be described in further detail below.

The transformer 112 and the transistors 110 form a transformer circuit coupled to the controller 104 and the CCFL 102 to provide current pulses at a secondary winding of the transformer circuit in response to the control signals at a primary winding of the transformer circuit. The transistors 110 are field effect transistors which convert control voltages from the controller 104 to current provided to the transformer 112. The transistors 110 operate in response to gating signals from the controller 104. The transformer 112 in turn amplifies the current and voltage to levels necessary to drive the CCFL 102.

The CCFL 102 in the illustrated embodiment is a cold cathode fluorescent lamp of the type used for backlight illumination of liquid crystal displays. In response to current provided by the transformer 112, the CCFL 102 produces a lamp current through the plasma contained within the glass tube of the CCFL 102. The current in turn causes illumination of the CCFL 102. The lamp current is detected by the controller 104 at pins 19 and 20 of the controller 104.

Further, as noted above, the lamp current is detected through the diode 140 by the feedback comparator circuit 108. Other types of fluorescent or discharge (e.g., xenon) lamps may be used in place of the CCFL in conjunction with the control circuit 100.

The illustrated embodiment of the control circuit 100 includes further sensing and controlling circuitry, as illustrated in FIG. 1. These additional elements will not be described in further detail but may be eliminated, supplemented or substituted for as necessary and as understood by one ordinarily skilled in the art. In the schematic diagram of FIG. 1, capacitor values are expressed in microfarads and rated at 50 volts. Resistor values are expressed in ohms and rated at either 1/10 or 1/16 W.

Figures 1, 2:
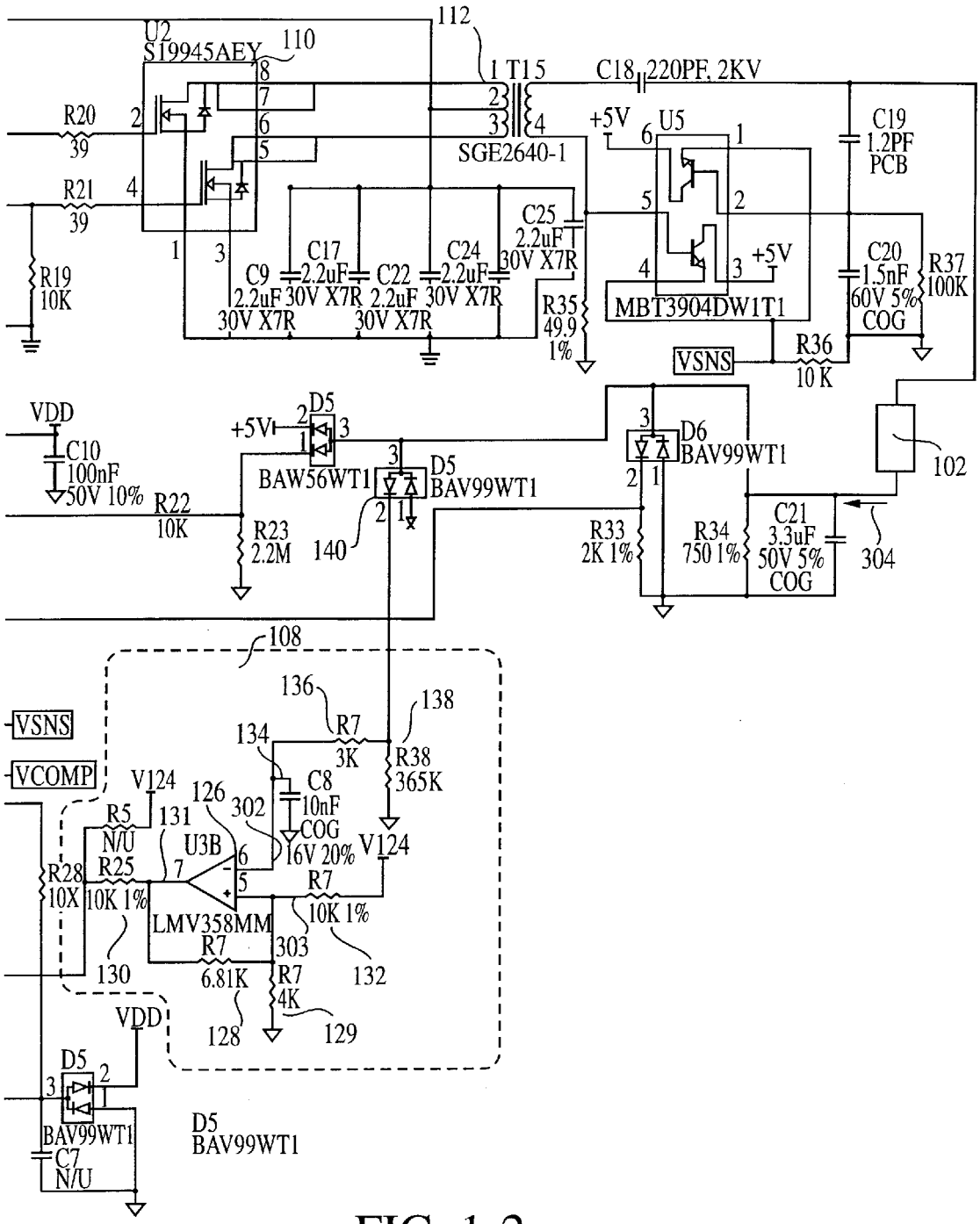
Figure 2:
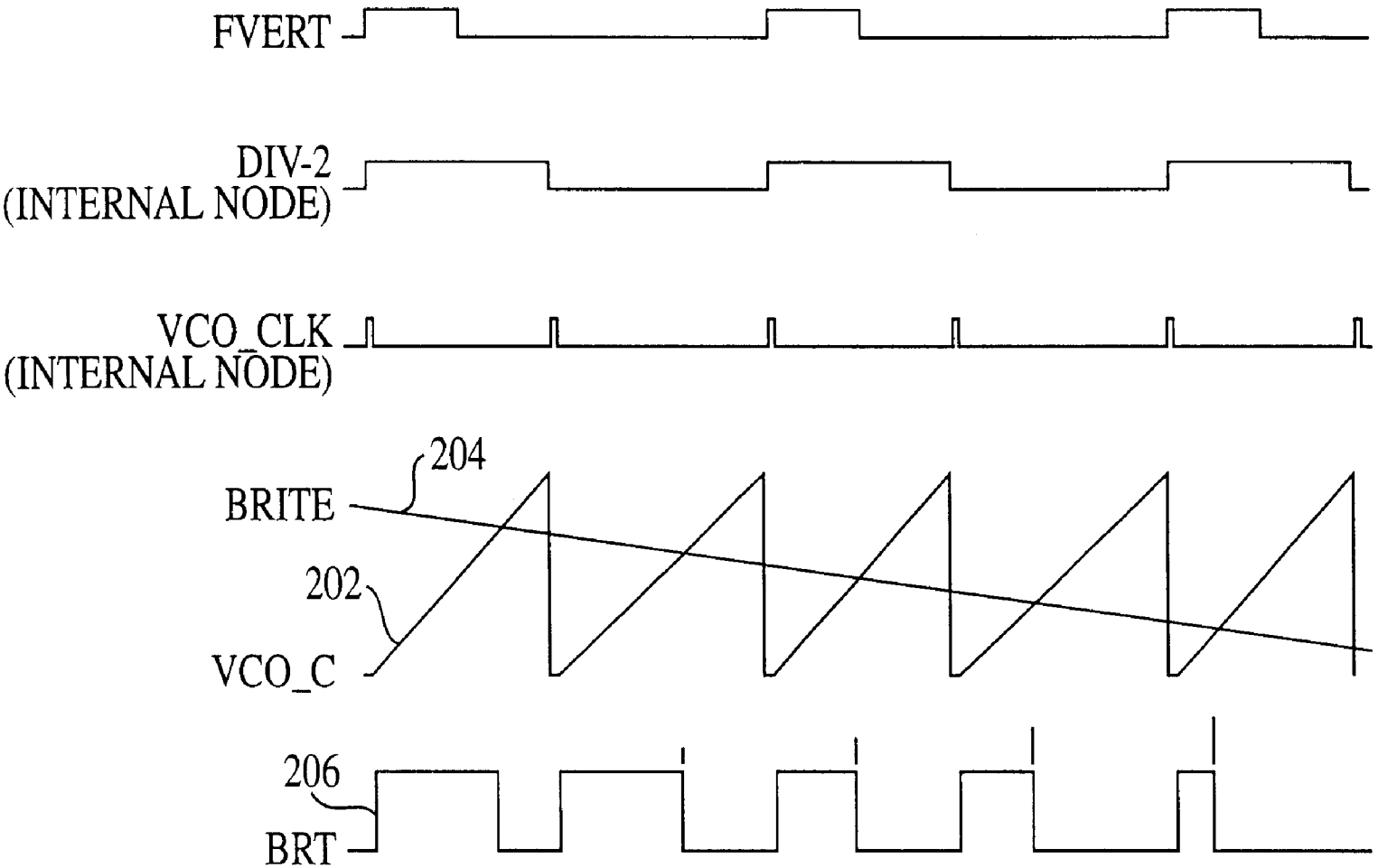

FIG. 2 is a timing diagram illustrating operation of the control circuit 100. In operation, the controller 104 generates a substantially periodic signal which, in the illustrated embodiment is a pulse width modulated (PWM) ramp voltage signal 202. Ramp voltage signal 202 is generated at VCO_C pin 9 of the controller 104. This ramp voltage signal 202 is synchronized with an incoming vertical synchronization signal at pin 7 of the controller 104. In a typical application, the ramp voltage signal 202 has a frequency two times the vertical synchronization rate. Preferably, the doubling of the frequency is accomplished by means of a phase locked loop circuit.

A comparator internal to the controller IC 104 is used to compare the PWM ramp voltage signal 202 to an input control signal 204 labeled BRITE. When the control signal 204 is above the ramp voltage signal 202, the controller 104 produces the BRT control signal 206. The BRT signal 206 is used internally by controller 104 to control the percent "on" time that transistors 110 and transformer 112 are driven at the inverter frequency of 60–80 KHz. In response, the transformer circuit 112 drives the CCFL 102, providing current pulses at approximately 76 KHz to the CCFL 102 to illuminate the CCFL 102.

When the BRITE control signal 204 is below the PWM ramp voltage signal 202, the internal comparator is turned off and the CCFL 102 is not driven. In FIG. 2, the control signal 204 is shown decreasing in magnitude over time to produce a dimming of the CCFL 102. Therefore, as the level of the BRITE control signal voltage 204 is lowered, the percent on time is reduced until the BRITE control signal 204 is below the bottom of the PWM ramp voltage signal 202. In this case, the controller 104 goes into a restriking mode of operation which is adequate to produce a low level flicker in the CCFL 102 but not to fully illuminate the CCFL 102.

To limit the input control signal so that the voltage will not fall below the bottom of the PWM ramp voltage, the control circuit 100 includes a diode 122 and a resistor divider reference network including resistor R6. Previous methods added a resistor from the cathode of diode 122 to a positive supply which together with resistor 120 formed a resistor divider network whose voltage was slightly above the bottom of the PWM voltage ramp. Under control of this additional circuitry, if the BRITE control signal 204 goes to, for example, zero volts, the diode 122 becomes reverse biased and the resistive divider reference supplies a voltage slightly above the bottom of the PWM ramp voltage. In many applications, this modification turns the CCFL on for a predetermined number of cycles and keeps the controller 104 from going into its restriking operational mode.

Unfortunately, due to temperature variants in the PWM ramp voltage signal 102, the number of minimum cycles provided by the modified circuit can vary dramatically over operating temperature of the circuit 100 when the bottom of the voltage ramp becomes greater than the resistor divider voltage due to temperature coefficient drift. As a result, flicker occurs under some operating conditions of the CCFL 102 and the control circuit 100. In one operating condition, at a temperature of −10° C., the restrike circuitry of the controller 104 was activated, indicating that the lamp current fell below a threshold value. During restriking, if the situation is not resolved within a predetermined time, the controller 104 is completely shutoff for safety reasons. Accordingly, the restriking mode is to be avoided.

If the minimum reference voltage provided by the voltage divider including resistor 120 is raised to prevent flicker, then the minimum number of pulses would be so large at high temperature operation that unacceptable dimming performance would result. For example, the dimming ratio available at an ambient temperature of 25° C. could only be 4.6:1. This dimming ratio is far below the ratio required for typical applications. At high temperature, the available dimming ratio is even less. An alternative proposed variation involves adding a diode to the voltage reference circuit to adjust the reference over temperature. While this proposed modification provides some improvement, the number of pulses produced by the controller 104 still varies over temperature and still does not obtain the desired low luminance levels that the controller 104 is capable of.

In order to overcome these problems, the feedback comparator circuit 108 is added to the control circuit 100. The feedback comparator circuit 108 uses a current sample signal from the CCFL 102 taken through diode 140 to determine when to turn off the BRITE control signal, thus maintaining minimum brightness operation. In this manner, in response to an indication of current in the fluorescent lamp 102, the control circuit 100 provides at least a predetermined number of current pulses per period of the periodic signal to the fluorescent lamp 102. Since the actual CCFL current is used to establish the shutoff point, the control circuit 100, including the feedback comparator circuit 108, automatically compensates for PWM ramp variations over temperature and maintains a substantially constant minimum number of lamp cycles. Further, the feedback comparator circuit 108 provides the additional advantage of resetting itself for each ramp cycle, thereby providing minimum cycle control on a ramp-by-ramp basis. Lastly, the control provided by the feedback comparator circuit 108 can be overwritten by varying the BRITE control signal 204 as desired via the VBRITE pin 7 signal of connector 124. When the desired brightness level is adjusted away from the minimum end of the brightness range for the lamp 102, the feedback comparator circuit 108 is operationally removed from the control circuit 100.

Figure 3:
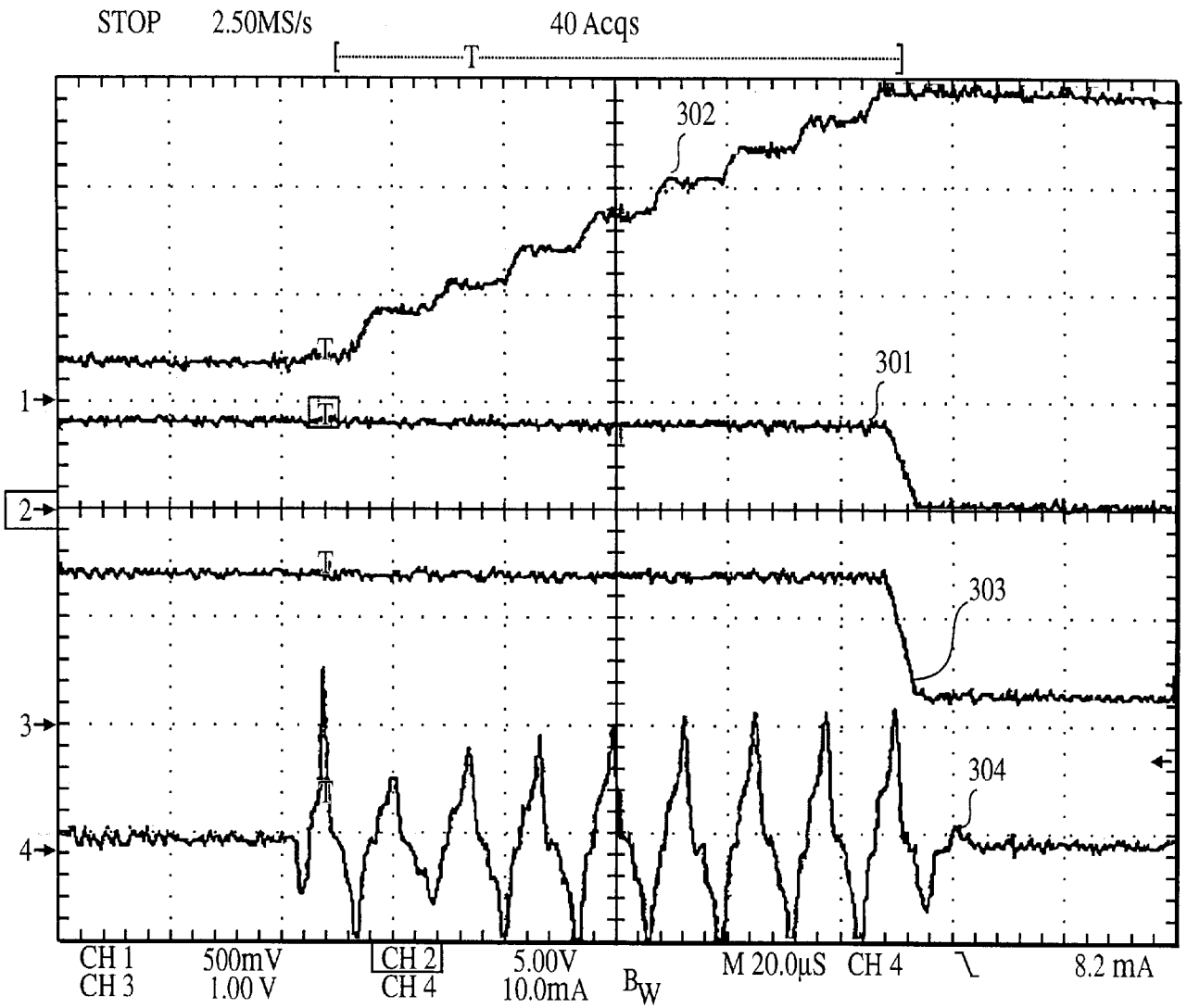
FIG. 3 is a second timing diagram illustrating operation of the control circuit of FIG. 1.

The circuit of FIG. 1 may best be understood in conjunction with the timing diagram of FIG. 3. FIG. 3 illustrates several signals present in the circuit 100 of FIG. 1. In FIG. 3, signal 301 corresponds to the signal at the output of the operational amplifier 126 of the feedback comparator circuit 108 of FIG. 1. Signal 302 corresponds to the voltage signal at the inverting input of the operational amplifier 126 of FIG. 1. Signal 303 corresponds to the voltage signal at the non-inverting input (pin 5) of the operational amplifier 126 of FIG. 1. Signal 304 corresponds to lamp current detected in the CCFL 102 of FIG. 1.

In FIG. 1, the diode 140 in conjunction with the resistor 136 and capacitor 134 produces the stair step waveform of signal 302 of FIG. 3. With each pulse of lamp current, signal 304, the capacitor 134, which nominally has a value of 10 nF, is charged by this current. Charging occurs through the 3 KΩ resistance, resistor 136. The voltage on the capacitor 134 tends to be discharged through the resistor 138. However, since the 365 KΩ resistance is so much larger than the 3 KΩ charging resistance of resistor 136, the discharging through the resistor 138 is very slow and is exceeded by charging through the resistor 136. For each lamp current cycle of the signal 304, a corresponding increase in the stair step voltage waveform is achieved.

The feedback comparator circuit 108 is arranged as a comparator, comparing the voltage at the inverting input and the voltage at the non-inverting input of the operational amplifier 126. These voltages are illustrated as signal 302 and signal 303 of FIG. 3. Until the stair step waveform of FIG. 3 reaches the voltage established at the non-inverting input and illustrated as signal 303 in FIG. 3, the output voltage of the operational amplifier 126 is at a maximum voltage of approximately 4 volts, as illustrated by signal 301 in FIG. 3. When the output voltage of the operational amplifier 126 is at 4 volts and the VBRITE control input (pin 7 of connector 124) signal is at zero volts, corresponding to a minimum brightness of the lamp 102, the voltage at the non-inverting input of the operational amplifier 114 is calculated by Equation 1.

$$V_{114} = \frac{4\ \text{V} \times 6\ \text{K}\Omega}{6\ \text{K}\Omega + 10\ \text{K}\Omega} = 1.5\ \text{V} \qquad \text{(Eq 1)}$$

Note that this voltage is much greater than the voltage required to maintain 20 current pulses per cycle of the ramp waveform at an operating temperature of −40° C., or 0.728 volts. Therefore, the divider voltage established by resistor 116 and resistor 130 is more than sufficient to ensure that the controller 104 will continue to be enabled when the PWM ramp signal traverses down to its minimum voltage.

When stair step waveform of signal 302 at the inverting input of the operational amplifier 126 reaches the voltage established at the non-inverting input, illustrated as signal 303, the output voltage corresponding to signal 301 switches to its logic low value, corresponding to ground in this case. This is due to the comparator operation of the operational amplifier 126. Prior to this transition, the comparison voltage at the non-inverting input is determined by Equation 2 and by the voltage at the output of the operational amplifier 126 (4 volts), the 1.25 V reference voltage and the resistor network including resistor 128, resistor 129 and resistor 132.

$$V_{+} = \frac{4\ \text{V} \times (10\ \text{K})(4\ \text{K}) + 1.25\ \text{V} \times (4\ \text{K})(6.81\ \text{K})}{(10\ \text{K})(6.81\ \text{K}) + (4\ \text{K})(6.81\ \text{K}) + (4\ K)(10\ \text{K})} = 1.43\ \text{V} \qquad \text{(Eq 2)}$$

When the signal 302 stair steps up to 1.43 volts, and the inverting input of the operational amplifier 126 becomes slightly larger than the non-inverting input, the output of the operational amplifier 126 transitions to its most negative value of zero volts and the controller 104 is shut off as the voltage at the input override circuit 106 becomes zero volts assuming that VBRITE of 124 is low enough so as not to cause diode 122 to become forward biased. This zero volt voltage is less than the most negative voltage of the PWM ramp voltage signal. Consequently, a predetermined number of CCFL current pulses are provided by the controller 104 before the control circuit 100 shuts off the controller 104. During this phase of its cycle, the feedback comparator circuit 108 operates to compare a signal related to current in the fluorescent lamp, signal 302, and a variable threshold signal, signal 303, to produce a control signal, signal 301 which controls the input override circuit 106 to ensure that at least a predetermined number of current pulses are provided to the CCFL 102 during each period of the ramp voltage signal, even at cold temperature.

Next, the feedback comparator circuit 108 goes into its reset cycle wherein the PWM ramp voltage must exceed a recover threshold or voltage of 1.5 volts (defined by Equation 1) before the output of the operational amplifier 126 is allowed to be reset to 4 volts. If this condition is not satisfied, the inverter would turn on again in the middle of the ramp until the ramp voltage exceeds 1.5 volts. The comparator circuit 108 determines the reset time by controlling the discharge of the 10 nF capacitor 134 through the 365 KΩ resistor 138 and 3K resistor 136. The discharge voltage at the inverting input of the operational amplifier 126 is described by Equation 3 and is illustrated in FIG. 4.

$$V_=1.43V \times e^{-t/(10nF \times 368K\Omega)} \qquad \text{(Eq 3)}$$

Figure 4:
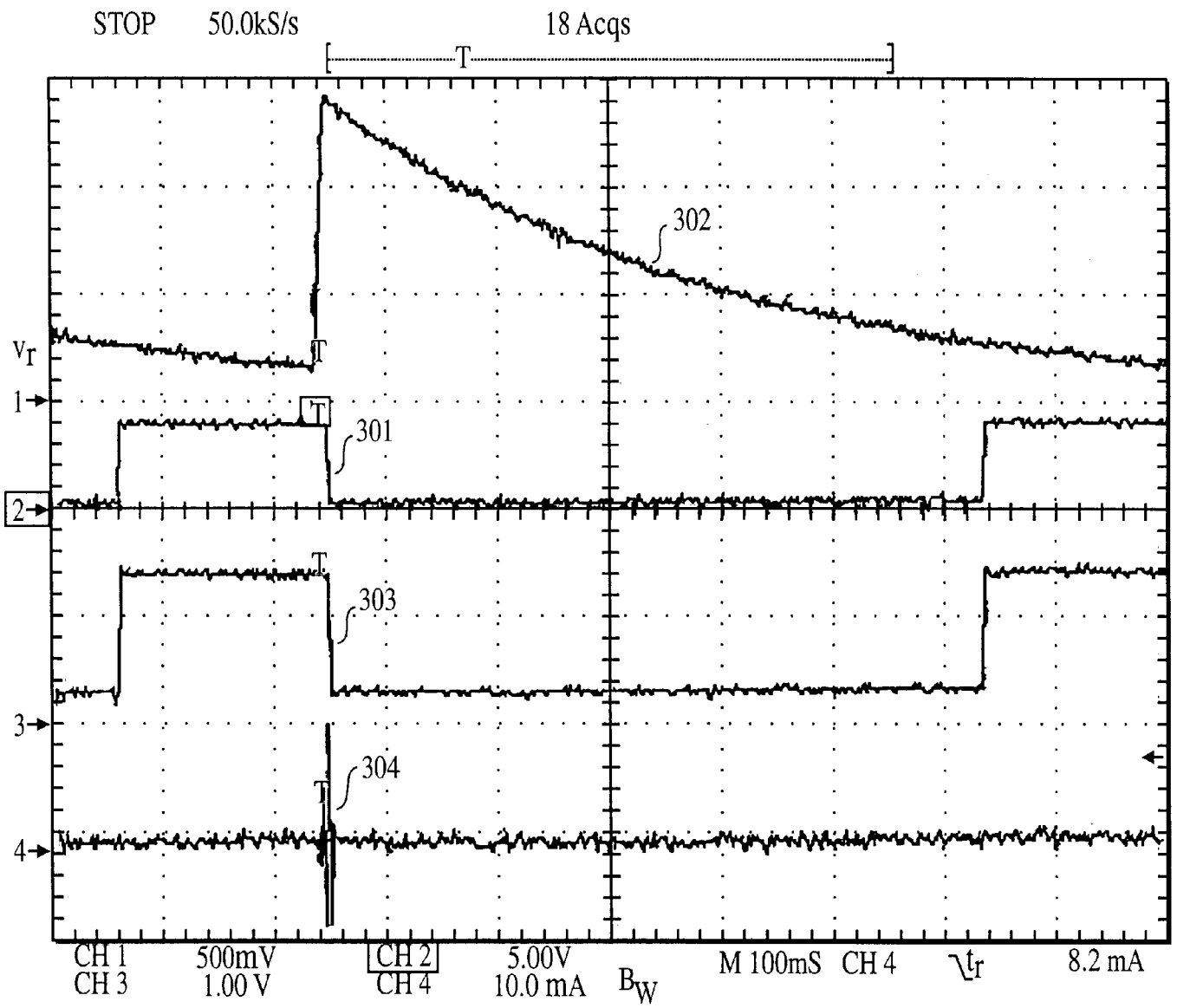
FIG. 4 is a third timing diagram illustrating operation of the control circuit of FIG. 1.

FIG. 4 is a timing diagram illustrating several signals corresponding to signals in the control circuit 100 of FIG. 1. The signals illustrated in FIG. 4 correspond to the signals illustrated in FIG. 3. However, in FIG. 4 the horizontal time scale has been altered to show full operation of the feedback comparator circuit 108, including the reset operation. In FIG. 3, the horizontal timescale is 20 microseconds per division. In FIG. 4, the horizontal timescale is set to 1.0 ms per division.

The pulse width modulated (PWM) ramp voltage internal to controller 104 can be described by Equation 4.

$$V_{PWMRamp} = 0.5\ \text{V} + \frac{2\ \text{V} \times t}{8.333\ \text{ms}} \qquad \text{(Eq 4)}$$

By substituting a value of 1.5 volts into Equation 4, the time before which the circuit cannot be reset can be determined by Equation 5.

$$t = \frac{(1.5\ \text{V} - 0.5\ \text{V}) \times 8.33\ \text{mS}}{2\ \text{V}} = 4.17\ \text{ms} \qquad \text{(Eq 5)}$$

Substituting this time t=4.17 ms into Equation 3 yields the voltage at the inverting input of the operational amplifier 126, as calculated by Equation 6.

$$V_=1.43V \times e^{-4.17\ mS/(10nF \times 368K)}=0.46V \qquad \text{(Eq 6)}$$

Therefore, the reset voltage established at the non-inverting input of the operational amplifier 126 must be less than 0.46 volts. However, since the reset action must occur before the next PWM ramp signal reset time of 8.33 ms, the minimum reset voltage at the non-inverting input of the operational amplifier 126 can be calculated by substituting this time 8.33 ms for t in Equation 3. This is shown in Equation 7.

$$V_=1.43V \times e^{-8.33\ ms/(10nF \times 368K\Omega)}=0.148V \qquad \text{(Eq 7)}$$

Therefore the reset voltage at the non-inverting input of the operational amplifier 126 must be greater than 0.148 volts and less than 0.46 volts. In the embodiment illustrated in the drawing, the reset voltage established by the control circuit 100 is determined by Equation 8, which calculates the voltage with the output of the operational amplifier 126 at zero volts.

$$V_{PIN3} = \frac{(6.81\ \text{K}\Omega)(4\ \text{K}\Omega) \times 1.25\ \text{V}}{(6.81\ \text{K}\Omega)(4\ \text{K}\Omega) + 10\ \text{K}\Omega(6.81\ \text{K}\Omega + 4\ \text{K}\Omega)} = 0.251\ \text{V} \quad \text{(Eq 8)}$$

In FIG. 4, the voltage on the signal 302 has exponentially decayed to 0.25 volts when the reset action occurs. At time $t_r$, once the voltage on the inverting input of the operational amplifier 126, signal 302, falls slightly below the 0.25 volts at the non-inverting input, signal 303, the output of the operational amplifier 126, signal 301, returns to its most positive output voltage and the circuit is reset to allow the cyclic action to occur of turning on the controller 104 when the PWM ramp voltage signal traverses back down to 0.5 volts. In FIG. 4, the reset voltage $V_r$ is indicated for the signal 302 at the inverting input of the operational amplifier 126.

Thus the illustrated embodiment implements a variable threshold voltage for actuating the controller 104 of FIG. 1. A first threshold voltage is established for comparing with the voltage on the capacitor 134 due to lamp current. When this threshold is exceeded, the BRITE control signal is turned off or disabled by clamping at a voltage level for sufficient time to ensure a minimum number of current pulses to the CCFL. The threshold is adjusted to a recover threshold to ensure that no additional current pulses are provided during the PWM voltage ramp when the lamp should be dimmed to the barely discernable level. When the compared voltage becomes lower than the recover voltage, the BRITE control signal is released and the feedback control circuit resets for the next period of the PWM voltage signal. If the VBRITE voltage of connector 124 is raised such that diode 122 is forward biased, the VBRITE signal will override the voltage developed by amplifier 126 at the node formed by R6 and R7 due to the impedance provided by R25. When VBRITE causes the voltage at this node to exceed the voltage required for the minimum cycle count, the circuit 108 becomes essentially non-operational and has no effect on the normal brightness control operation. Only when the voltage at the R6/R7 node drops below that required for minimum cycle count, the circuit 108 becomes operational and ensures minimum cycle count for each voltage ramp cycle.

It should be noted that when using the LM358 operational amplifier to perform the function of the operational amplifier 126, the maximum output voltage from the operational amplifier 126 is 4.0 volts using a 5.0 volts as the positive supply voltage. In other embodiments, the maximum output voltage available from an operational amplifier may be higher, such as 5 volts using a rail-to-rail amplifier with a 5V supply. It is within the scale of those ordinarily skilled within the art to modify the calculations herein and substitute alternative circuit components to achieve similar operability.

From the foregoing, it can be seen that the present embodiments provides an improved control circuit for a cold cathode fluorescent lamp. The control circuit monitors a lamp current sample signal and, when a predetermined number of current pulses has occurred, the control circuit turns off the controller. After a predetermined time, the control circuit is reset for the next PWM ramp cycle. In this manner, a predetermined number of inverter cycles is maintained over the entire desired temperature range and the lowest possible dimming level is achieved over the entire operating range.

While a particular embodiment of the present invention has been shown and described, modifications may be made. For example, digital logic devices such as comparators and counters may be substituted for analog components such as operational amplifiers shown in the illustrated embodiment to provide advantages of reduced cost, size and power drain. Further, individual voltage, current and device values may be varied to optimize performance to a particular application. Accordingly, it is therefore intended in the appended claims to cover such changes and modifications which follow in the true spirit and scope of the invention.

I claim:

1. A method of eliminating flicker for a lamp assembly, the method comprising:

generating a substantially periodic ramp voltage signal;

in response to the substantially periodic ramp voltage signal, providing current pulses to a fluorescent lamp to illuminate the fluorescent lamp; and in response to an indication of current in the fluorescent lamp, providing at least a predetermined number of current pulses per period of the substantially periodic ramp voltage signal to the fluorescent lamp.

2. The method of claim 1 further comprising:

maintaining the current in the fluorescent lamp above a predetermined current threshold by providing at least the predetermined number of current pulses per time period.

3. A method of eliminating flicker for a lamp assembly, the method comprising:

generating a substantially periodic ramp voltage signal;

in response to the substantially periodic ramp voltage signal, providing current pulses to a fluorescent lamp to illuminate the fluorescent lamp;

in response to an indication of current in the fluorescent lamp, providing at least a predetermined number of current pulses per period of the substantially periodic ramp voltage signal to the fluorescent lamp;

receiving a dimming level input signal;

varying the current pulses provided to the fluorescent lamp in response to level of the dimming level input signal;

detecting current pulses in the fluorescent lamp; and when a detected number of current pulses in the fluorescent lamp falls below a predetermined current threshold, providing at least the predetermined number of current pulses per period of the periodic signal to the fluorescent lamp independent of the level of the dimming level input signal.

4. The method of claim 3 further comprising:

comparing the dimming level input signal to the substantially periodic ramp voltage signal;

providing the current pulses to the fluorescent lamp when the dimming level input signal exceeds a threshold related to amplitude of the substantially periodic ramp voltage signal; and in response to the detected current in the fluorescent lamp, clamping the dimming level input signal at a level at least equal to a minimum value of the substantially periodic ramp voltage signal to provide at least the predetermined number of current pulses per period of the substantially periodic ramp voltage signal.

5. The method of claim 4 further comprising:

varying the threshold to a recover voltage following a predetermined time to prevent provision of additional current pulses during a present period of the periodic ramp voltage signal.

6. The method of claim 5 further comprising:

resetting the threshold to an initial value for each period of the periodic ramp voltage signal.

7. The method of claim 6 further comprising:

detecting the periodic ramp voltage signal; and when the periodic ramp voltage signal is less than a reset value, providing additional current pulses to the fluorescent lamp.

8. A control circuit for a fluorescent lamp, the control circuit comprising:

a controller generating control signals in response to a received brightness control signal;

an amplifying circuit coupled to the controller and the fluorescent lamp to provide current pulses at an output in response to the control signals at an input of the amplifying circuit;

a comparator which compares a dimming level input signal and a time varying signal to produce the brightness control signal; and a feedback circuit which detects current in the fluorescent lamp to control the dimming level input signal at predetermined operating conditions of the control circuit.

9. The control circuit of claim 8 wherein the amplifying circuit comprises:

a transformer having a primary winding to receive control signals and a secondary winding to provide the current pulses in response to the control signals.

10. The control circuit of claim 8 wherein the feedback circuit is configured to maintain the dimming level input signal at a voltage level for a time sufficient to ensure provision of a minimum number of current pulses before reducing the dimming level input signal to a level less than the time varying signal to interrupt further current pulses.

11. The control circuit of claim 10 wherein the feedback circuit comprises:

a comparator which compares a voltage related to the current in the fluorescent lamp and a threshold voltage having an initial value related to a value of the dimming level input signal.

12. The control circuit of claim 11 further comprising:

biasing circuitry which varies the threshold voltage between the initial value of the threshold voltage and a recover value of the threshold voltage.

13. A method for operating a fluorescent lamp, the method comprising:

producing a ramp voltage waveform;

receiving a dimming level input signal associated with a desired dimming level for the fluorescent lamp;

comparing the ramp voltage waveform and the dimming level input signal;

generating current pulses for the fluorescent lamp when the ramp voltage waveform is less than the dimming level input signal;

detecting fluorescent lamp current; and in response to the detected fluorescent lamp current, clamping the dimming level input signal at a minimum value sufficient to eliminate flicker in the fluorescent lamp at desired operating conditions.

14. The method of claim 13 wherein clamping the dimming level input signal comprises:

charging a storage device in response to the detected fluorescent lamp current;

comparing voltage on the storage device with a threshold voltage; and when the voltage on the storage device exceeds the threshold voltage, releasing the clamping of the dimming level input signal.

15. The method of claim 14 wherein releasing the clamping of the dimming level input signal comprises:

resetting an output of a comparator to a voltage below the dimming level in put signal;

varying the threshold voltage to a recover voltage; and in the comparator, comparing the voltage on the charge storage device and the recover voltage.

16. A control circuit for a fluorescent lamp, the control circuit configured to receive a dimming level input signal and to produce a ramp voltage wave form and current pulses when the ramp voltage wave form is less than the dimming level input signal by comparing the ramp voltage wave form and the dimming level input signal in a comparator, the control circuit comprising:

a feedback comparator configured to compare a signal related to current in the fluorescent lamp and a variable threshold signal to produce a control signal which controls the feedback comparator to ensure at least a predetermined number of current pulses are provided to the fluorescent lamp during each period of the ramp voltage wave form at a desired operating condition.

17. The improved control circuit of claim 16 wherein the feedback comparator is configured to maintain at least the predetermined number of current pulses to the fluorescent lamp independent of operating temperature.

18. A method for operating a fluorescent lamp, the method comprising:

providing current pulses to the fluorescent lamp;

monitoring lamp current in the lamp; and in response to the lamp current, adjusting number of current pulses to the fluorescent lamp to substantially eliminate visible flicker of the fluorescent lamp.

19. The method of claim 18 further comprising:

in response to the lamp current, maintaining a minimum number of current pulses per time period independently of operating temperature of the fluorescent lamp.

20. A controller for a fluorescent lamp comprising:

an input circuit which receives a dimming level input signal;

a circuit which provides a variable number of current pulses per time period to the fluorescent lamp, the number of current pulses being related to value of the dimming level input signal; and an input override circuit configured to override the dimming level input signal to ensure that at least a minimum number of current pulses per time period are provided to the fluorescent lamp.

21. A method for operating a fluorescent lamp, the method comprising:

providing current pulses to the fluorescent lamp during duration of a pulse-width modulation signal to illuminate the fluorescent lamp;

interrupting provision of the current pulses when a threshold is exceeded;

suspending provision of subsequent current pulses during a recovery time; and after the recovery time, again providing the current pulses to the fluorescent lamp.

22. The method of claim 21 further comprising:

ensuring a minimum number of current pulses are provided before interrupting provision of the current pulses to substantially eliminate visible flicker of the fluorescent lamp.

23. A method for operating a fluorescent lamp, the method comprising:

providing current pulses to the fluorescent lamp during duration of a pulse-width modulation signal to illuminate the fluorescent lamp;

in response to the current pulses, generating a stair step signal indicative of number of pulses provided;

comparing the stair step signal with a threshold value; and interrupting provision of the current pulses when the threshold is exceeded by the stair step signal.

24. The method of claim 23 further comprising:

ensuring a minimum number of current pulses are provided before interrupting provision of the current pulses to substantially eliminate visible flicker of the fluorescent lamp.

* * * * *

UNITED STATES PATENT AND TRADEMARK OFFICE

CERTIFICATE OF CORRECTION

PATENT NO. : 6,670,781 B2
DATED : December 30, 2003
INVENTOR(S) : Paul F. L. Weindorf It is certified that error appears in the above-identified patent and that said Letters Patent is hereby corrected as shown below:

Column 12,
Line 7, delete "in put" and substitute -- input -- in its place.

Signed and Sealed this

Twenty-fifth Day of May, 2004

JON W. DUDAS
*Acting Director of the United States Patent and Trademark Office*